United States Patent [19]

Griggs

[11] 4,245,843

[45] Jan. 20, 1981

[54] HOCKEY TARGET

[76] Inventor: Denis O. Griggs, 102 Spire Hillway, Willowdale, Ontario, Canada, M2H 3A6

[21] Appl. No.: 66,274

[22] Filed: Aug. 13, 1979

[30] Foreign Application Priority Data

Aug. 15, 1978 [CA] Canada ..... 309431

[51] Int. Cl.[3] ..... A63B 69/00

[52] U.S. Cl. ..... 273/393; 273/1 B; 273/380; 273/407; 273/411

[58] Field of Search ..... 273/1 B, 365, 380, 393, 273/411, 407

[56] References Cited

U.S. PATENT DOCUMENTS

| | | | |
|---|---|---|---|
| 1,023,634 | 4/1912 | Ferguson | 273/393 X |
| 1,378,340 | 5/1921 | Fairchild | 273/380 |
| 2,039,782 | 5/1936 | Doty | 273/393 |
| 3,185,480 | 5/1965 | Weyman et al. | 273/365 |
| 3,853,319 | 12/1974 | Swanson | 273/365 |
| 3,856,298 | 12/1974 | Frantti | 273/1 B |

FOREIGN PATENT DOCUMENTS

| | | | |
|---|---|---|---|
| 97420 | 7/1924 | Austria | 273/393 |
| 501100 | 1/1920 | France | 273/393 |

*Primary Examiner*—Paul E. Shapiro

*Attorney, Agent, or Firm*—Hirons, Rogers & Scott

[57] ABSTRACT

A hockey shooting target comprises a target element mounted in a peripheral framework, from which the element is removed on being struck by a properly aimed hockey puck, ball, etc. A saddle is provided for mounting the framework at suitable locations in the goalmouth of a hockey net. The target element is of flexible compressible impact resistant material, e.g. rubbery foam polyurethane, to permit its repeated re-use as a target element.

7 Claims, 4 Drawing Figures

HOCKEY TARGET

This invention relates to targets and more particularly to targets for use in practice in the game of ice hockey.

The game of hockey, when played on correct ice surfaces with a puck or as "shinny" on a hard road surface with a ball, by children or adults, calls for the accurate shooting of the puck or ball at the goal net. Aiming of the puck at the sides and corners of the net is a desirable skill, but one which is not easy to practice merely with an open goal as shooting target.

There has recently been promoted through the mass media a shooting accuracy competition for professional hockey players, in which targets are positioned at various extremities of the goal, at which the shooter aims, no goaltender being present in the nets. The targets present a front target surface, and break into pieces upon being struck by the puck. Such a target shooting arrangement, in addition to providing a competitive situation as played by the professional hockey players, offers substantial possibilities for practice and training of hockey players on ice, and a pleasant recreational pastime. However, targets which break into pieces when hit, although satisfying and pleasing to the participants, are not acceptable for regular hockey practice and training sessions, because of expense and because of the debris which results, to litter the ice surface.

It is an object of the present invention to provide a novel hockey target arrangement which can be used in hockey practice and training sessions.

It is a further object to provide such a hockey target arrangement which is relatively inexpensive and can be used many times over.

The present invention provides a hockey target arrangement which essentially comprises a framework and a target element which fits releasably in the framework. The framework can be releasably secured to the goalposts or crossbar of a hockey goal at substantially any preselected position, to provide a target. The target element is retained in the framework until it is struck by the aimed puck or ball, but as a result of such impact it is knocked out of the frame. The target element is made to be impact resistant, yet flexible and compressible, so that it will withstand many such impacts and can be replaced in the target framework simply and easily for the next shooter. Thus, the shooter gets the satisfaction of causing the assembly to fly apart after shooting accurately, but does not cause breakage or debris.

Thus, according to the present invention there is provided a hockey shooting target assembly comprising:

a flexible compressible impact resistant target element having a front target surface and an opposed reverse surface;

an impact resistant framework defining an aperture for reception therein of the target element;

the target element being a releasable interference fit in the aperture of the framework and removable therefrom by impacts administered to the target surface thereof;

means for attaching the framework to a hockey goalpost or crossbar so that the target surface of the target element mounted in said framework is presented forwardly of the goal mouth.

Suitably the target element is made of soft flexible foam rubber or plastic, e.g. foam rubbery polyurethane, which is readily compressible to fit in the framework and be removed therefrom on impact, but will stand up to repeated such impacts and reloadings. Appropriate target indicia may be provided on its front target surface.

The framework is preferably of low temperature impact resistant plastic, such as polypropylene, impact polystyrene, ABS resin, polycarbonate, nylon and the like. It is preferred that the assembly as a whole be circular, with a disc-like foam rubber target element and a circular framework. A retaining lip is also suitably provided in the framework so that the disc can be initially releasably retained therein until it is struck on its front target face.

The means for attaching the framework to the post or crossbar of the goal is suitably an integral saddle formation protruding outwardly from the side of the framework. This saddle is provided with a formation to cooperate with the upright post so that when clamped thereto, e.g. by a flexible releasable strap, the framework will be held upright and substantially in the plane of the goal mouth. When it is desired to support the target from the crossbar, it can if desired merely be suspended therefrom by its flexible straps, but it is preferably clamped thereto using the saddle, so as to ensure the removal of the disc from the framework on impact.

The size of the target element and assembly according to the invention can be varied within certain limits. Suitably, however, the target assembly has an overall diameter of approximately 12–16 inches, most preferably about 15 inches, and the saddle extends for a distance of from about one to about five inches, preferably $1\frac{1}{2}$–$2\frac{1}{2}$ inches, in the tangential direction, so as to provide a satisfactorily long clamping surface for securing to the post.

A specific preferred embodiment of the invention is illustrated in the accompanying drawings, in which.

In the drawings, like reference numerals indicate like parts.

Figure 1:
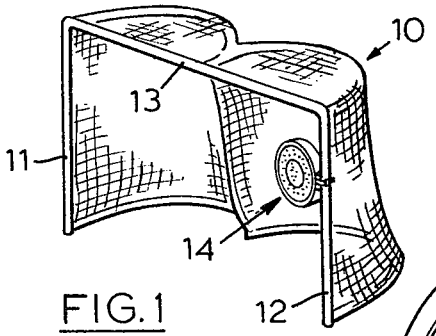
FIG. 1 is a general perspective view of a hockey goal net, with a target assembly according to the invention clamped to a post thereof at an appropriate location.

With reference to FIG. 1, there is shown a hockey goal net 10 of conventional form, with a pair of opposed upright goalposts 11, 12 and a crossbar 13 defining a goal mouth. Secured to the post 12 is a hockey target assembly 14 in accordance with the invention.

Figure 2:
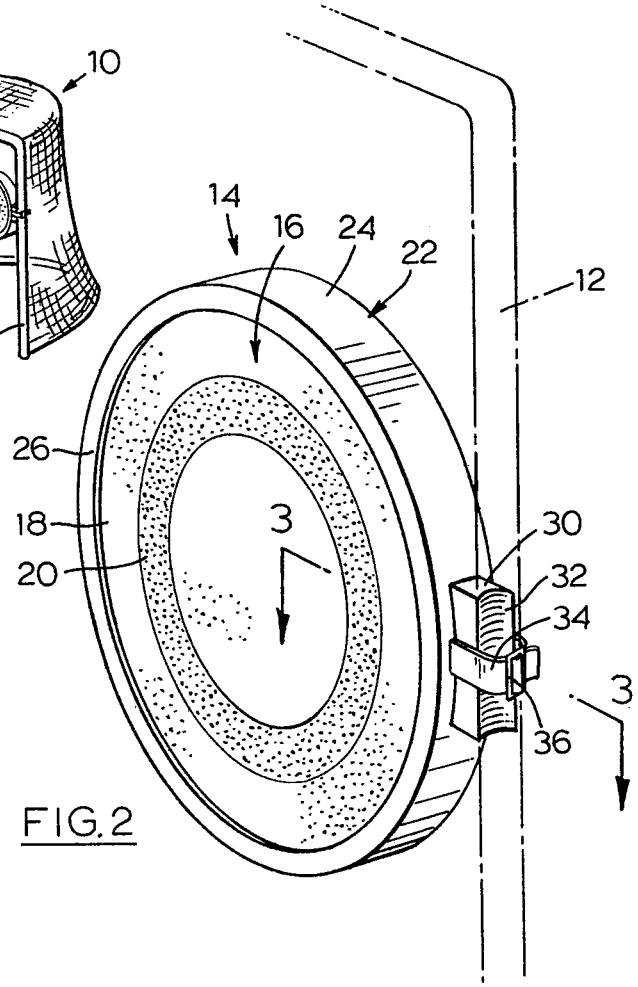
FIG. 2 is a larger perspective view of the target assembly of FIG. 1.
Figure 3:
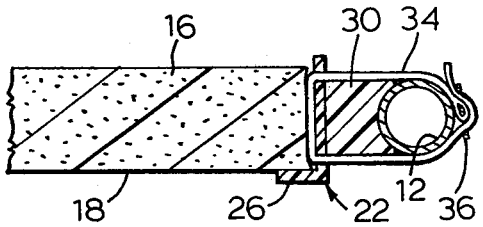
FIG. 3 is a sectional view along the line 3—3 of FIG. 2.

Referring to FIGS. 2 and 3, the target assembly 14 comprises a target element 16 of disc-like form, and made of flexible rubbery foam polyurethane. The target element 16 has a front target surface 18 provided with a coloured target ring 20 printed thereon. There is provided an annular framework 22, into which the target element 16 is fitted as an interference fit.

The framework 22 is circular as viewed from the front, and has a generally cylindrical side wall 24 of substantially the same axial length as the thickness of the disc-like target element 16.

The frame 22 is provided with an inwardly extending front lip 26, integral with and extending inwardly at right angles to the front edge of side wall 24. In the assembly, the edge of the target face 18 of target element 16 is received against the inner surface of front lip 26, which acts as a retaining lip and restraint against forward removal of the disc element from the framework. Its cylindrical side wall and integral front lip, defining an internal right angle into which the disc 16 can fit, provides a suitable retaining configuration, which effectively prevents accidental removal of the disc therefrom, e.g. by wind forces.

The framework 22 is also provided with a means for attaching the assembly to a goal post 11, 12 or crossbar 13. This comprises an integral saddle 30 protruding radially outwardly from one side location of the framework 22. The saddle 30 has a radially outer surface 32 in the form of a shallow, part circular section channel, sized to fit snugly around a portion of the periphery of post 12. A strap 34 with a securing buckle 36 passes through apertures on either side of saddle 30 in the side wall 24 of framework 22, to be fastened around post 12 so as to clamp the target in position with the channel surface 32 of the saddle 30 against the post. The channel surface 32 is long enough so that the target assembly 14 as a whole remains upright when so clamped against the post 12. The length of the saddle surface 32 is about two inches.

Figure 4:
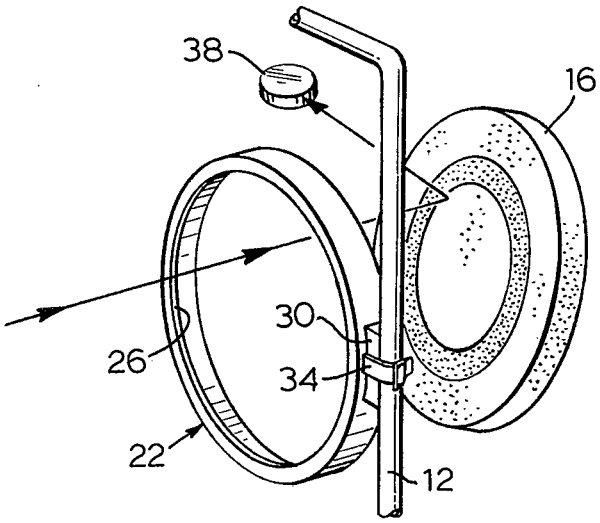
FIG. 4 is a view similar to FIG. 2, showing the target element dislodged from the frame as a result of impact on its target surface.

Thus, the assembly 14 can be readily secured to any convenience position of the goal framework to act as a shooting target in the goal mouth. The assembly is arranged so that the front lip 26 of the framework 22 and the target surface 18 of the target disc 16 are presented forwardly. When struck by the correctly aimed puck 38, as shown in FIG. 4, the target element 16 flies out of the framework 24, since it is resilient and flexible enough easily to pass through side wall 24 rearwardly, even if originally mounted therein in a resiliently compressed state. Suitably, when correctly struck, the disc element 16 is caught in the hockey net, to avoid tedious retrieval thereof. The target element is robust enough to withstand repeated impacts. Re-loading of the flexible compressible resilient target element in the framework is a simple matter. The plastic framework is a simple L-shape, rendering it simple and economical to manufacture.

It will be appreciated that the embodiment of the invention described herein in detail and illustrated herein is given by way of example, and is not to be construed as limiting. For example, additional restraining formations protruding inwardly from the side wall surface, e.g. a small rear restraining lip can be provided if desired. Also, alternative attaching means such as releasable bolts, encircling clamps, hose clamps, straps and the like can be adapted if desired. The scope of the invention is defined solely by the appended claims.

The embodiments of the invention in which an exclusive property or privilege is claimed are defined as follows:

1. A hockey shooting target assembly comprising:

a flexible compressible impact resistant target element having a front target surface and an opposed rear surface;

an impact resistant framework defining an aperture for reception therein of the target element;

the target element being a releasable interference fit in the aperture of the framework and removable therefrom by impacts administered to the target surface of the target element;

means for attaching the framework to a hockey goal post or crossbar so that the target surface of the target element mounted in said framework is presented forwardly of the goal mouth.

2. The target assembly of claim 1 wherein the framework has a front face comprising a peripheral inwardly extending front lip and a side wall extending rearwardly from said front lip, the target element being received as an interference fit against the side wall thereof, with its front target surface towards said front lip.

3. The target assembly of claim 2 wherein the means for attaching the framework comprises a saddle formation extending outwardly therefrom, said saddle formation having an outer surface shaped to co-operate with a hockey goal post, and a releasable strap for securing the saddle formation to the goal post.

4. The target assembly of claim 3 wherein the saddle formation is integral with the framework, and the outer surface thereof comprises a shallow channel, extending for a length of at leat one inch, so as to retain the framework in fixed angular relationship with respect to the plane of the goal mouth when the framework is secured to a goal post by engagement of said channel therewith.

5. The target assembly of claim 1, claim 3 or claim 4 wherein the framework is a generally planar annular ring and the target element is a disc of suitable diameter to be received as an impact susceptible interference fit in the annulus defined by the side wall of said ring.

6. The target assembly of claim 3 wherein the framework is a generally planar annular ring and the target element is a disc of suitable diameter to be received as an impact suseptible interference fit in the annulus defined by the side wall of said ring, the side wall of said framework being cylindrical and the front and rear lips extending inwardly at right angles thereto.

7. The target assembly of claim 6 wherein the target element is made of soft resilient foam rubber or plastic.

* * * * *